US011578940B2

(12) United States Patent
Lake

(10) Patent No.: US 11,578,940 B2
(45) Date of Patent: Feb. 14, 2023

(54) FIREARM TRIGGER MECHANISMS WITH ROTATABLE LINKAGE MEMBERS AND ASSOCIATED SYSTEMS AND METHODS

(71) Applicant: Nosler, Inc., Bend, OR (US)

(72) Inventor: Mike Lake, Bend, OR (US)

(73) Assignee: Nosler, Inc., Bend, OR (US)

( * ) Notice: Subject to any disclaimer, the term of this patent is extended or adjusted under 35 U.S.C. 154(b) by 171 days.

(21) Appl. No.: 16/983,238

(22) Filed: Aug. 3, 2020

(65) Prior Publication Data

US 2020/0363154 A1 Nov. 19, 2020

Related U.S. Application Data

(62) Division of application No. 15/851,306, filed on Dec. 21, 2017, now Pat. No. 10,767,950.

(51) Int. Cl.

| | |
|---|---|
| ***F41A 19/10*** | (2006.01) |
| ***F41A 17/46*** | (2006.01) |
| ***F41A 19/16*** | (2006.01) |
| ***F41A 19/12*** | (2006.01) |
| ***F41A 17/56*** | (2006.01) |
| ***F41A 19/31*** | (2006.01) |

(52) U.S. Cl.

CPC ..... *F41A 19/10* (2013.01); *F41A 17/46* (2013.01); *F41A 17/56* (2013.01); *F41A 19/12* (2013.01); *F41A 19/16* (2013.01); *F41A 19/31* (2013.01)

(58) Field of Classification Search

CPC ..... F41A 19/10; F41A 17/46; F41A 17/56; F41A 19/12; F41A 19/16; F41A 19/31

See application file for complete search history.

(56) References Cited

U.S. PATENT DOCUMENTS

| | | | | | |
|---|---|---|---|---|---|
| 1,625,768 | A * | 4/1927 | Barnes | F41A 19/17 | 42/69.02 |
| 2,249,231 | A * | 7/1941 | Smith | F41A 19/16 | 74/2 |
| 2,249,232 | A * | 7/1941 | Smith | F41A 19/31 | 74/2 |
| 2,856,717 | A * | 10/1958 | Parke | F41A 19/17 | 42/16 |
| 3,548,530 | A * | 12/1970 | Rohm | F41A 19/10 | 42/69.01 |
| 3,707,796 | A * | 1/1973 | Bielfeldt | F41A 17/56 | 42/70.04 |

(Continued)

*Primary Examiner* — Michelle Clement
(74) *Attorney, Agent, or Firm* — Perkins Coie LLP

(57) ABSTRACT

Firearm trigger mechanisms with rotatable linkage members and associated systems and methods are disclosed herein. A firearm trigger assembly configured in accordance with embodiments of the present technology can include, for example, a trigger, first and second linkage members, and a sear. The first linkage member, second linkage member, and sear are arranged in an over-center configuration that securely locks the sear in a first position. Pulling on the trigger causes the trigger to rotate about a fixed pivot point and push on one of the two linkage members, forcing the linkage members and the sear out of the over-center configuration. The force from a striking mechanism forces the sear and the linkage members into a collapsed configuration, releasing the striking mechanism and firing the firearm. This two toggle configuration of the trigger assembly provides crisp and reliable release of the firearm.

9 Claims, 3 Drawing Sheets

(56) References Cited

U.S. PATENT DOCUMENTS 4,040,196 A * 8/1977 Smith ..... F41A 15/08 42/23
4,449,313 A * 5/1984 Hackett ..... F41A 9/62 42/69.01
4,625,444 A * 12/1986 Beretta ..... F41A 19/17 42/69.01
4,908,970 A * 3/1990 Bell ..... F41A 19/12 42/69.01
5,187,312 A * 2/1993 Osborne ..... F41A 19/32 42/69.01
5,363,581 A * 11/1994 Blenk ..... F41A 19/31 42/69.02
5,487,233 A * 1/1996 Jewell ..... F41A 19/16 42/69.01
5,718,074 A * 2/1998 Keeney ..... F41A 19/45 42/69.01
5,852,891 A * 12/1998 Onishi ..... F41A 19/17 42/69.01
7,698,845 B2 * 4/2010 Hochstrate ..... F41A 19/48 42/69.01
7,810,268 B1 * 10/2010 McGarry ..... F41A 19/35 42/69.01
8,099,895 B2 * 1/2012 Farley, Jr. ..... F41A 19/12 89/136
8,109,025 B2 * 2/2012 Stone ..... F41A 19/45 42/69.01
8,117,957 B2 * 2/2012 Loganchuk ..... F41A 3/38 42/1.06
8,132,349 B1 * 3/2012 Huber ..... F41A 19/12 42/69.01
8,677,665 B1 * 3/2014 Huber ..... F41A 19/12 42/69.01
9,222,746 B2 * 12/2015 Doll ..... F41A 17/46
9,372,047 B2 * 6/2016 Cho ..... F41A 19/03
9,671,186 B1 * 6/2017 Hoekema ..... F41A 19/17
9,696,104 B1 * 7/2017 Bloomfield ..... F41A 19/10
10,132,586 B1 * 11/2018 Hoekema ..... F41A 19/29
10,767,950 B2 * 9/2020 Lake ..... F41A 19/16
11,029,116 B2 * 6/2021 Biegel ..... F41A 19/10
2005/0011098 A1 * 1/2005 Fagundes de Campos ..... F41A 17/72 42/70.04
2005/0183311 A1 * 8/2005 Diaz ..... F41A 19/16 42/69.01
2010/0024273 A1 * 2/2010 Duperry ..... F41A 19/16 42/69.01
2010/0236120 A1 * 9/2010 Stone ..... F41A 19/45 42/69.01
2011/0277367 A1 * 11/2011 Krieger ..... F41A 19/16 42/69.01
2012/0005934 A1 * 1/2012 Doll ..... F41A 17/58 42/69.01
2015/0168091 A1 * 6/2015 Doll ..... F41A 17/46 42/69.01
2015/0292828 A1 * 10/2015 Nebeker ..... F41A 17/46 42/69.01
2016/0305730 A1 * 10/2016 Dextraze ..... F41A 19/10
2019/0195588 A1 * 6/2019 Lake ..... F41A 19/16
2020/0041222 A1 * 2/2020 Lobert ..... F41A 19/10

* cited by examiner

FIREARM TRIGGER MECHANISMS WITH ROTATABLE LINKAGE MEMBERS AND ASSOCIATED SYSTEMS AND METHODS

CROSS-REFERENCE TO RELATED APPLICATION(S)

This application is a division of U.S. patent application Ser. No. 15/851,306 filed on Dec. 21, 2017, which is incorporated herein by reference in its entirety.

TECHNICAL FIELD

The present technology relates generally to trigger mechanisms for firearms. In particular, several embodiments of the present technology are related to firearm trigger mechanisms with rotatable linkage members and associated systems and methods.

BACKGROUND

Firearm trigger mechanisms typically include numerous interconnected components that require precise manufacturing and calibration to ensure proper engagement for consistent firing of the firearm. Each trigger component includes precisely machined surfaces that interlock and disengage with adjoining surfaces to provide consistent, crisp trigger engagement and release. For example, pulling a firearm trigger causes the multiple interlocking surfaces of the trigger mechanisms to slide with respect to each other to release a striking element (e.g., a firing pin, hammer, bolt, striker, etc.) from an initial or primed position. Upon release, a spring pushes the striking element forward to ignite the primer of a cartridge, causing a bullet to be expelled from a barrel of the firearm. When the striking element is in the initial primed position, a retention component (often referred to as a sear) holds the striking element in a fixed position and prevents the spring from pushing the striking element towards the cartridge. The sear is positioned in the travel path of the striking element (e.g., in the direction of the spring force) to prevent forward movement of the striking element. Pulling the trigger moves the sear out of the way of the striking element, thereby allowing the spring to push the striking element towards the cartridge and causing the firearm to fire.

Before firing, the force exerted by the spring causes the striking element to apply pressure on an engagement surface of the sear. In typical firearm firing mechanisms, the position of the sear during the process of pulling the trigger (i.e., the process of moving the sear out of the way of the striking element), is directly dependent on the position of the trigger as the trigger is pulled from the initial position to the second position. When the trigger has been pulled only partway between the initial position and the second position, the sear is only partially moved out of the way of the striking element. At this point, the force exerted by the spring on the striking element remains unchanged, while the surface area of the sear's engagement surface has decreased, thereby increasing the stress on the sear's engagement surface.

To ensure that the engagement surface of the sear does not deform due to the increased stress, the sear is formed from specific materials that undergo intricate material processing (e.g., extensive heat treatment processes) in order to increase the hardness of the sear's engagement surface. Despite the laborious manufacturing, however, repeated and prolonged use of the firearm can still result in deformation of the sear.

DETAILED DESCRIPTION

The present technology is generally directed to firearm trigger mechanisms with rotatable linkage members and associated systems and methods. Specific details of several embodiments of the present technology are described herein with reference to FIGS. 1-3B. Although many of the embodiments are described with respect to devices, systems, and methods for actuating a firearm with a rotatable trigger lever, other applications and other embodiments in addition to those described herein are within the scope of the present technology. For example, at least some embodiments of the present technology may be useful for firearms that are actuated by users using non-rotatable trigger means (e.g., sliding or depressing an actuator). It should be noted that other embodiments in addition to those disclosed herein are within the scope of the present technology. Further, embodiments of the present technology can have different configurations, components, and/or procedures than those shown or described herein. Moreover, a person of ordinary skill in the art will understand that embodiments of the present technology can have configurations, components, and/or procedures in addition to those shown or described herein and that these and other embodiments can be without several of the configurations, components, and/or procedures shown or described herein without deviating from the present technology.

As used herein, the terms "rearward" and "forward" define positions or directions with respect to a firearm user positioned behind the trigger of the firearm. The terms "rearward," "backward," and derivations thereof refer to a position near or in a direction toward the firearm user. The term "forward" and derivations thereof refer to a position distant from or in a direction away from the firearm user. For example, in the orientation of the embodiments illustrated in FIGS. 1-3B, backward and related terms refer to a position or direction toward the left of the page, whereas forward and related terms refer to a position or direction toward the right of the page.

As used herein, the terms "clockwise" and "counterclockwise" define exemplary directions of rotation of various components of firearm trigger systems based on the orientation of the embodiments illustrated in FIGS. 1-3B. These directions are not intended to be limiting, but instead only to provide examples of the relative movement of trigger system elements. In some embodiments, for example, the direction of rotation of the various elements described herein may be reversed.

Figure 1:
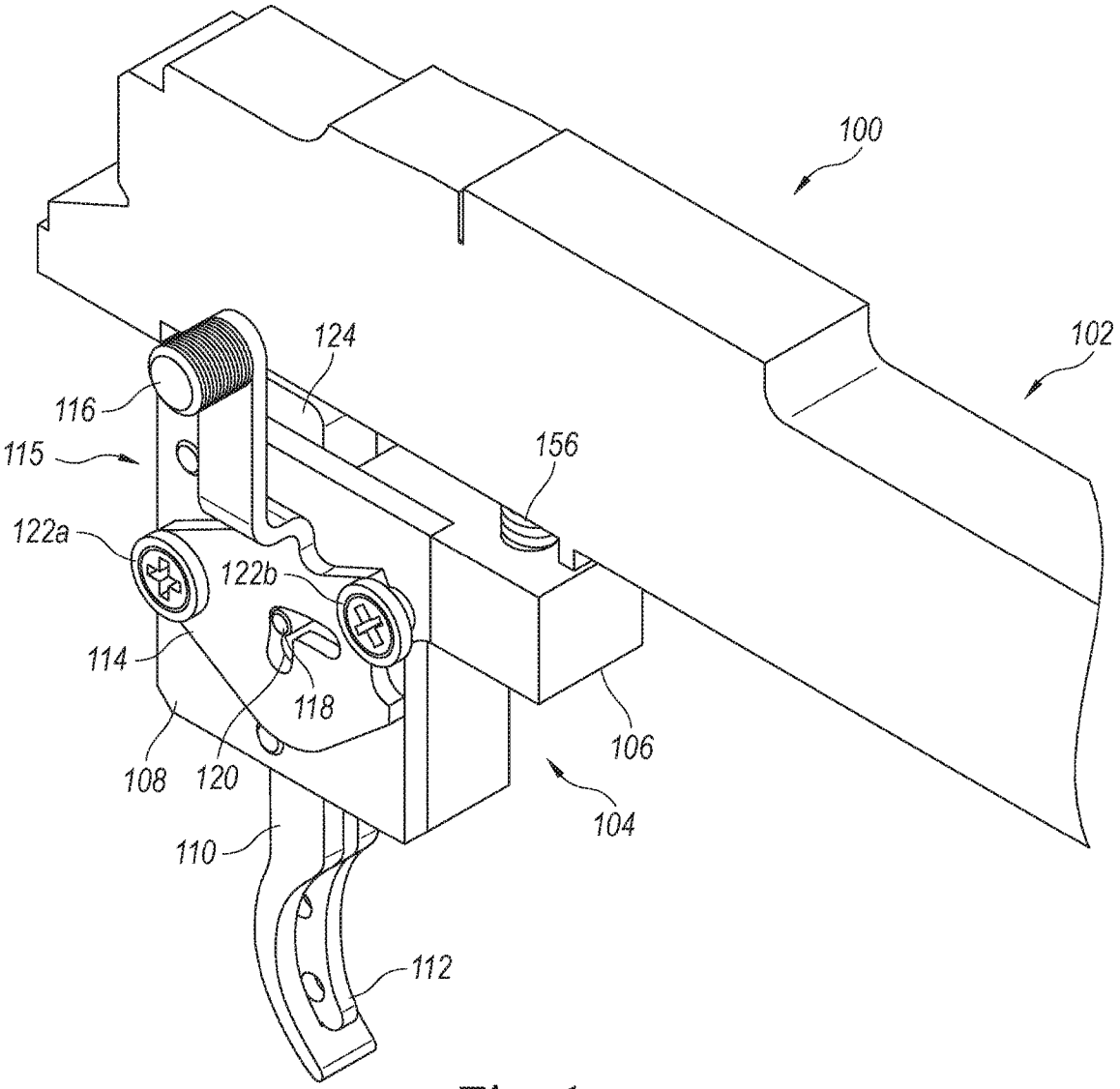
FIG. 1 is an isometric view of a portion of a firearm including a trigger assembly configured in accordance with embodiments of the present technology.
Figure 2:
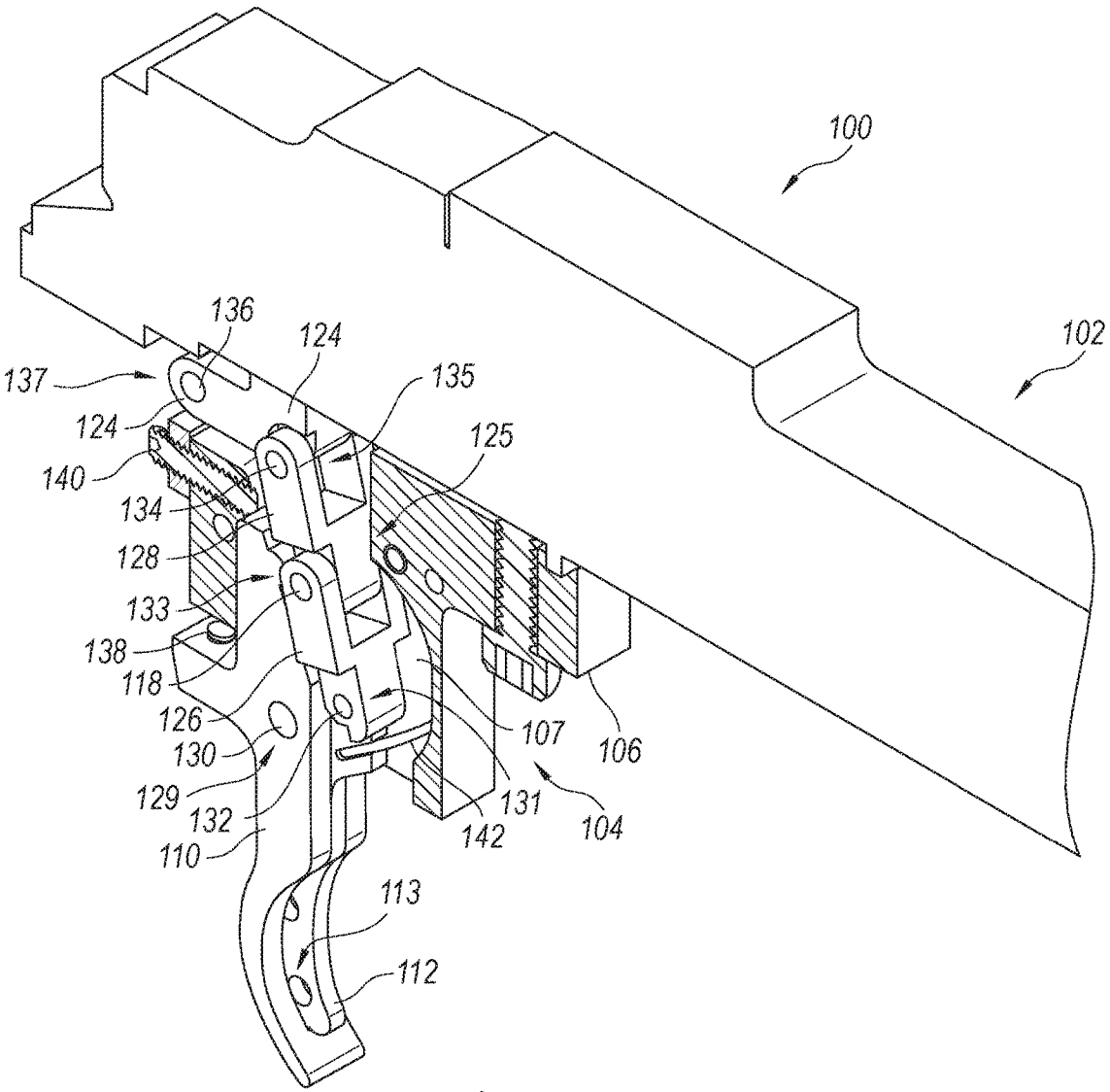
FIG. 2 is partial cutaway isometric view of the firearm of FIG. 1 illustrating internal components of the trigger assembly configured in accordance with embodiments of the present technology.

FIG. 1 is an isometric view of a portion of a firearm 100 including a striking assembly 102 (also referred to as a "striking mechanism") and a trigger assembly 104 (also referred to as a "trigger mechanism") configured in accordance with embodiments of the present technology, and FIG. 2 is a partial cutaway isometric view of the firearm 100 of FIG. 1 illustrating internal components of the trigger assembly 104. As shown in FIG. 1, the trigger assembly 104 includes a trigger housing 106 and a trigger housing side plate 108 that enclose the inner components (shown in FIG. 2) of the trigger assembly 104. The trigger assembly 104 also includes a trigger lever 110 (also referred to as a "trigger") that can be manipulated by a user to disengage a sear 124 from a portion of the striking assembly 102. One or more connecting members (e.g., a screw 156) may be used to attach the trigger housing 106 to the striking assembly 102. As will be discussed in greater detail below, moving the trigger lever 110 in a rearward direction (i.e., toward a user) moves internal components of the trigger assembly 104, which causes the sear 124 to disengage from the striking assembly 102, allowing the striking assembly to strike a primer (or other ignition mechanism) of a cartridge (not shown). This ignites a propellant in the cartridge and fires a bullet from the firearm 100.

In various embodiments, the firearm 100 may include a safety mechanism 115 to prevent an inadvertent discharge of the cartridge caused by a user unintentionally pulling the trigger lever 110. The safety mechanism 115 can include a safety plate 114 attached to the trigger housing side plate 108 and a safety lever or knob 116 extending from the safety plate 114. For example, the safety plate 114 can be attached to the trigger housing 106 with a first retainer member 122*a* (e.g., a screw) such that the safety plate 114 is rotatable about the first retainer member 122*a* and a second retainer member 122*b* (e.g., a screw) is configured to act as a guide along which the safety plate 114 rotates. In other embodiments, the safety plate 114 can be attached and moveable with respect to the trigger housing 106 via differently configured retainer members and/or other connecting members. The safety plate 114 includes a safety guide 120 defined by a recess, aperture, or slot in the safety plate 114. The safety guide 120 is sized and shaped to receive a linkage shaft 118 (also referred to as a "toggle shaft", a "shaft", a "dowel", and/or a "toggle dowel") and can have a selected shape that limits the movement of the linkage shaft 118 in at least one direction. The linkage shaft 118 is operably coupled to components of the trigger assembly 104 such that limiting movement of the linkage shaft 118 via the safety mechanism 115 also limits movement of portions of the trigger assembly 104 that result in firing of the firearm 100. In the illustrated embodiment, the safety guide 120 has an "L" or bent shape that limits movement of the linkage shaft 118 along a predefined path and blocks movement of the linkage shaft 118 in certain directions. In other embodiments, the safety guide 120 has different shapes that restrain movement of the linkage shaft 118.

To actuate the safety mechanism 115, a user can manipulate the safety knob 116 to rotate the safety plate 114 about the first retainer member 122*a* and move the safety mechanism 115 between an unlocked state (shown in FIG. 1) and a locked state. In the illustrated embodiment, the linkage shaft 118 (connected to the internal trigger assembly components) moves forward to disengage the sear 124 from the striking assembly 102 and enable firing the firearm 100. When the safety mechanism 115 is in the unlocked state (FIG. 1), the safety mechanism 115 does not prevent the linkage shaft 118 from moving freely along the safety guide 120 and, therefore, the linkage shaft 118 is free to move forward (e.g., in horizontal direction) to enable firing. In the locked state, the safety mechanism 115 prevents the linkage shaft 118 from moving along the safety guide 120 (e.g., in a forward direction) when the trigger lever 110 is pulled and, therefore, prevents the trigger assembly 104 from unintentionally actuating. To move the safety mechanism 115 to the locked state, the user can manipulate the safety knob 116 (e.g., pull the safety knob 116 in a rearward direction toward the user) to rotate the safety plate 114 about the first retainer member 122*a* in a counterclockwise direction. This rotation of the safety plate 114 causes the safety guide 120 to move upwards (i.e., toward the striking assembly 102) into the locked state, while the linkage shaft 118 remains stationary within the safety guide 120. For example, in the locked state, the rotation of the safety plate 114 moves the linkage shaft 118 to a position within the vertical portion of the safety guide 120 (i.e., the portion of the slot extending perpendicular to the travel path of the linkage shaft 118), thereby blocking horizontal or forward movement of the linkage shaft 118 and preventing the firearm 100 from firing. To move the linkage shaft 118 back to the unlocked state, the user manipulates the safety knob 116 (e.g., pushes the safety knob 116 in a forward direction away from the user) to rotate the safety plate 114 about the first retainer member 122*a* in a clockwise direction. This moves the safety guide 120 downwards (i.e., away from the striking assembly 102) while the linkage shaft 118 remains stationary. The linkage shaft 118 is then positioned within the portion of the safety guide 120 (e.g., the horizontal portion) that allows the linkage shaft 118 to move along the safety guide 120 (e.g., in the forward direction), which allows the trigger assembly 104 to actuate when the trigger lever 110 is pulled.

Referring now to FIG. 2, the trigger assembly 104 includes a linkage assembly 125 operably coupled to the trigger lever 110. The trigger lever 110 can be rotatably coupled to trigger housing 106 with a trigger-housing shaft 130 at a fixed joint 129 (also referred to as a "first fixed joint" or a "fixed pivot point"). The linkage assembly 125 includes a first linkage member 126 (also referred to as "toggle," "toggle link," "link," or "linkage") rotatably coupled to a second linkage member 128. The first linkage member 126 is coupled to the trigger housing 106 with a linkage-housing shaft 132 (also referred to as a "shaft," "dowel," or "toggle-housing dowel") at a fixed joint 131 (also referred to as a "third fixed joint," "linkage-housing joint," or a "fixed pivot point") such that the linkage-housing shaft 132 is stationary relative to the trigger housing 106 and the first linkage member 126 is rotatable about the linkage-housing shaft 132. The first and second linkage members 126 and 128 are rotatably coupled together via the linkage shaft 118, which forms a first movable joint 133 (also referred to as a "first joint" or a "movable pivot point") that moves its position relative to the trigger housing 106 as the first linkage member 126 rotates about the linkage-housing shaft 132. The second linkage member 128 is connected to the sear 124 with a linkage-sear shaft 134 that forms a sear joint 135 (also referred to as a "second joint" or a "movable pivot point"), and the sear 124 is coupled to the trigger housing 106 with a sear-housing shaft 136 at a fixed joint 137 (also referred to as a "second fixed joint" or a "fixed pivot point"). Movement of the first movable joint 133 and the associated rotation of the first and second linkage members 126 and 128 about the linkage shaft 118, causes the second linkage member 128 to rotate about the linkage-sear shaft 134 and allows the sear joint 135 to move relative to the trigger housing 106. This causes the sear 124 to rotate in a clockwise direction about the sear-housing shaft 136 and disengage with the striking assembly 102. As used herein, the terms "fixed joint" and "fixed pivot points" refer to connection points that remain in stationary positions relative to the trigger housing 106, whereas "movable joints" and "movable pivot points" have different positions relative to the trigger housing 106 depending upon the state of activation of the firearm 100. In other embodiments, the linkage assembly 125 can include additional linkage members positioned intermediate to the first and second linkage members 126 and 128, the second linkage member 128 and the sear 124, and/or the first linkage member 126 and the trigger housing 106. In further embodiments, the linkage assembly 125, the sear 124, the trigger lever 110, and/or the trigger housing 106 can be coupled together using other suitable mechanisms for creating fixed and rotatable joints.

As further shown in FIG. 2, the trigger assembly 104 may include an interlock blade 112, and the trigger lever 110 may include a slot or recess 113 configured to receive at least a portion of the interlock blade 112. The interlock blade 112 may be rotatably coupled to the trigger housing 106 and the trigger lever 110 via the trigger-housing shaft 130, which allows the interlock blade 112 to rotate about a fixed point (i.e., the first fixed joint 129) in a clockwise direction and move at least partially into the slot 113 of the trigger lever 110. When the interlock blade 112 is positioned within the slot 113, the trigger lever 110 and the interlock blade 112 can rotate together in a clockwise direction about the first fixed joint 129 to move the linkage assembly 125 and initiate firing of the firearm 100. As described in further detail below, the interlock blade 112 can be operably coupled to the linkage assembly 125 to serve as a safety mechanism that must first be actuated (e.g., pulled rearward toward the user) before the trigger lever 110 can be manipulated. In some embodiments, the interlock blade 112 may also be coupled to the trigger housing 106 via an interlock spring 142 and/or other return feature that moves the interlock blade 112 back into its initial, pre-actuated position. For example, the interlock spring 142 can stretch when the user pulls the interlock blade 112 at least partially retracted in the slot 113. Upon release of the interlock blade 112, the interlock spring 142 returns to its initial neutral state and applies a force on the interlock blade 112 that causes the interlock blade 112 to rotate in the counterclockwise direction about the trigger-housing shaft 130 until the interlock blade 112 returns to its first position.

Figure 3A:
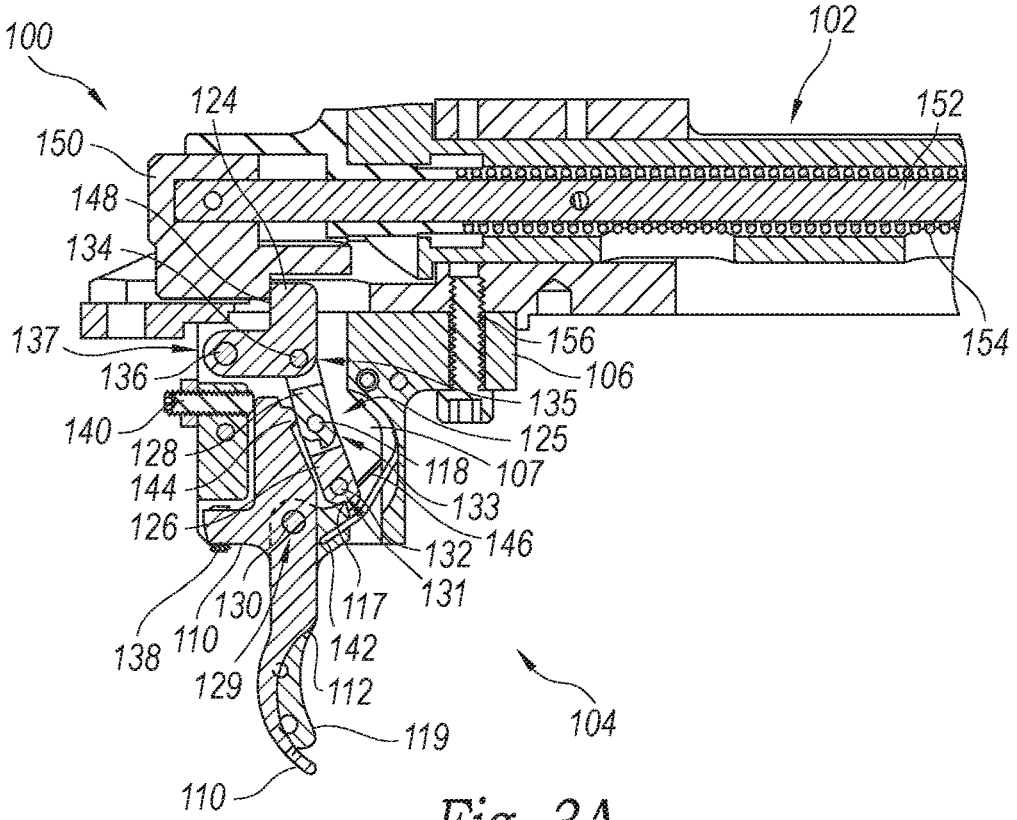
FIG. 3A is a side cross-sectional view of the trigger assembly of FIGS. 1 and 2 shown in a first state in accordance with embodiments of the present technology.
Figure 3B:
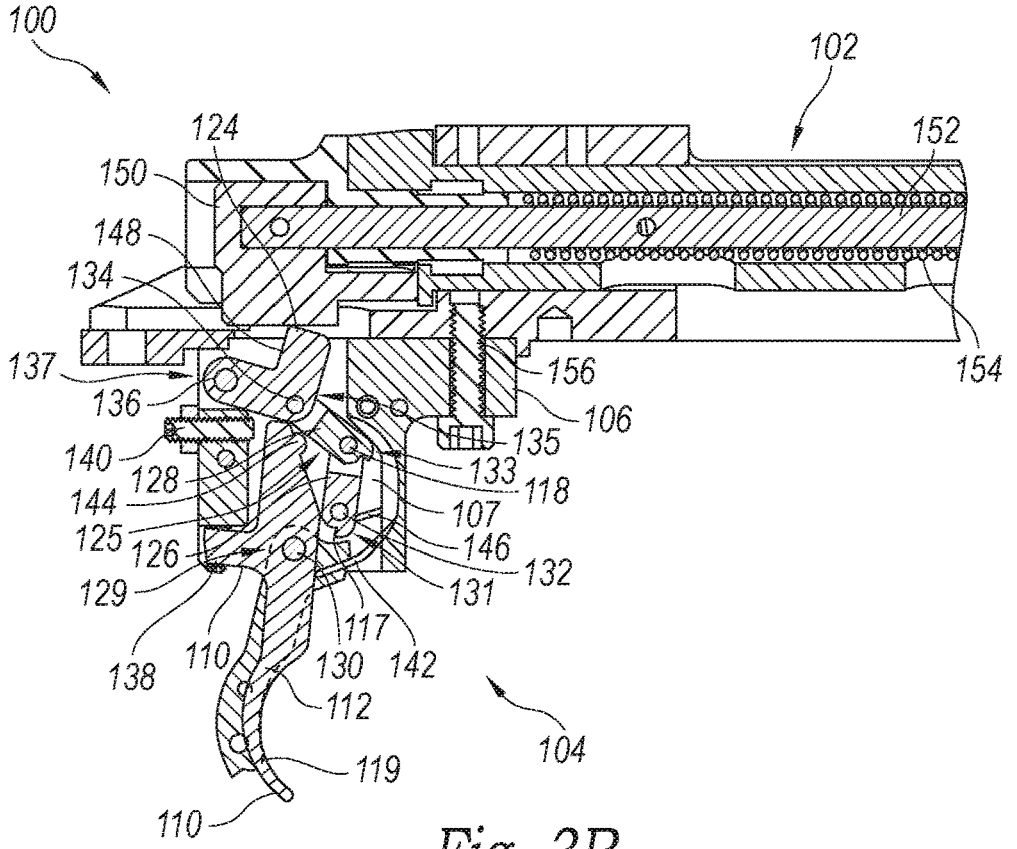
FIG. 3B is a side cross-sectional view of the trigger assembly of FIGS. 1 and 2 shown in a second state after the firearm trigger has been pulled in accordance with embodiments of the present technology.

FIG. 3A is a side cross-sectional view of the trigger assembly 104 of the firearm 100 of FIGS. 1 and 2 in a primed or first state (before firing the firearm 100) in accordance with embodiments of the present technology, and FIG. 3B is a side cross-sectional view of the trigger assembly 104 in an unprimed or second state (after firing the firearm 100). As shown in FIG. 3A, the striking assembly 102 engages with an engagement portion or surface 148 of the sear 124 when the trigger assembly 104 is in the first state. For example, the striking assembly 102 can include a striking feature 150 (also referred to as a "bolt") operably coupled to or including a firing pin 152 and a main spring 154. The main spring 154 can be coupled to the firing pin 152 (e.g., via an end portion of the spring), such that the spring 154 applies a force on the firing pin 152 in a forward direction (i.e., in a direction aligned with the longitudinal axis of the barrel of the firearm 100). When the sear 124 is unrestrained, the force of the striking feature 150 (caused by the spring 154 acting on the firing pin 152) against the engagement surface 148 causes the sear 124 to rotate in a clockwise direction about the sear-housing shaft 136 (i.e., the fixed pivot point), which allows the firing pin 152 to move forward in the direction of a loaded cartridge (not shown) to fire the firearm 100. However, in the first state (FIG. 3A), the sear 124 is supported by the linkage assembly 125 to maintain the sear 124 in an extended or first position, while the spring 154 (arranged in a compressed state) causes the striking feature 150 to apply pressure to the engagement surface 148. Thus, when the linkage assembly 125 is in the first state, the linkage assembly 125 prevents the sear 124 from rotating about the sear-housing shaft 136 and inhibits forward or longitudinal movement of the striking assembly 102 (e.g., caused by the forward force of the spring 154) that results in firing of the firearm 100. In other embodiments, the striking assembly 102 can include additional and/or different features that engage with the sear 124 when the trigger assembly 104 is in the first state and release from the sear 124 when the trigger assembly 104 is in the second state.

An end portion of the trigger lever 110 may include a protrusion 144 and/or other member that interfaces with the linkage assembly 125 to move the trigger assembly 104 from the first state to the second state. As shown in FIG. 3A, for example, when the firearm 100 is in the first state, the second linkage member 128 rests against the protrusion 144, which braces the second linkage member 128 and aids in preventing the clockwise rotation of the sear 124. In various embodiments, the protrusion 144 can support the linkage assembly 125 in an over-center configuration when the trigger assembly 104 is in the first state. In this configuration, a first line segment drawn between the linkage-housing shaft 132 and the linkage joint 133 and a second line segment drawn between the linkage joint 133 and the sear joint 135 form an angle of less than 180°. In some embodiments, the protrusion 144 supports the linkage assembly 125 in a centered configuration (also referred to as "top dead center") when the trigger assembly is in the first state. That is, the pivot points of the first and second linkage members 126 and 128 and the sear 124 are locked in a straight line such that the first and second line segments form an angle that is equal to about 180° (i.e., a straight line drawn between the linkage-housing shaft 132 and the sear joint 135 would intersect with the linkage joint 133). The over-center configuration and the centered configuration can also be defined in relation to a central axis extending through the linkage-housing shaft 132 and the sear joint 135. In the over-center configuration, the linkage joint 133 may be positioned on a first side of the central axis (e.g., rearward of the central axis). In the centered configuration, the linkage joint 133 may be aligned with and positioned along the central axis. After the trigger assembly 104 moves to the second state (after firing), the linkage joint 133 is positioned at a second side of the central axis opposite the first side.

In other embodiments, the protrusion 144 interfaces with different portions of the linkage assembly 125, such as the first linkage member 126, the linkage joint 133, and/or intermediate linkages. In further embodiments, the trigger assembly 104 includes intermediate components operably coupled to the trigger lever 110 and the linkage assembly 125 to support the linkage assembly 125 in the over-center configuration and/or the centered configuration when the trigger assembly 104 is in the first state and act on the linkage assembly 125 when the trigger lever 110 is pulled to move the linkage assembly 125 to the second state.

Whether in the over-center configuration or the centered configuration, both the protrusion 144 and the linkage-housing shaft 132 support the linkage assembly 125 in the first position (FIG. 3A), thereby preventing the sear 124 from rotating about the sear-housing shaft 136 and moving the second linkage member 128 in a downward direction (i.e., toward the linkage-housing shaft 132). The downward force applied by the sear 124 on the second linkage member 128 (e.g., via the striking feature 150 pressing against the engagement surface 148) also presses the second linkage member 128 against the protrusion 144, which may apply a counterclockwise rotational force on the trigger lever 110. This pushes a portion of the trigger lever 110 (e.g., opposite the protrusion 144) against an engagement member 140 (e.g., a screw) threadably received in the trigger housing 106 or otherwise adjustably coupled thereto. The engagement member 140 can be used to limit the counterclockwise rotation of the trigger lever 110 and adjust the resting or first position of the trigger lever 110 and, therefore, the first position of the linkage assembly 125 when the firearm 100 is in the first state. For example, moving the engagement member 140 forward towards the linkage assembly 125 moves the first position of the trigger lever 110 and the linkage assembly 125 closer to the top dead center configuration, whereas moving the engagement member 140 rearward away from the linkage assembly 125 moves the first position of the trigger lever 110 and the linkage assembly 125 to the over-center configuration. Because the engagement member 140 supports the trigger lever 110 in the first position, the trigger lever 110 applies a countering compressive force on the second linkage member 128 to maintain the linkage assembly 125 in the first position.

The over-center configuration and the centered configuration are inherently self-engaging. More specifically, as the force applied by the striking feature 150 on the engagement surface 148 of the sear 124 increases, the countering compressive forces from the trigger lever 110 and the first linkage member 126 onto the second linkage member 128, and therefore the sear 124, also increase. These opposing forces securely lock the sear 124 into the extended position (FIG. 3A), thereby preventing the firearm 100 from firing.

FIG. 3B illustrates the trigger assembly 104 of the firearm 100 in the second state after the trigger lever 110 has been pulled or otherwise engaged to activate the firearm 100. In the second state, the sear 124 moves to a retracted position out of the path of the striking feature 150 such that the engagement surface 148 no longer engages with the striking feature 150 in its initial rearward position. With the sear 124 in the retracted state, the main spring 154 is free to drive the striking feature 150 and the firing pin 152 towards the cartridge (not shown) to fire the firearm 100.

To initiate firing, a user pulls or otherwise manipulates the trigger lever 110 such that the trigger lever 110 rotates in a clockwise direction about the trigger-housing shaft 130. In various embodiments, the trigger lever 110 can include an over-travel member 138 (e.g., a screw) that limits the degree of clockwise rotation of the trigger lever 110 by adjusting the position of the over-travel member 138 relative to the trigger housing 106. For example, translating the over-travel member 138 toward the trigger housing 106 reduces the degree of clockwise rotation of the trigger lever 110, whereas translating the over-travel member 138 in the opposite direction away from the trigger housing 106 increases the degree of clockwise rotation of the trigger lever 110. Accordingly, the over-travel member 138 can prevent excess rotation of the trigger lever 110 (often referred to as "over-travel"), which can reduce the comfort and/or crispness of the release of the trigger lever. In other embodiments, the trigger assembly 104 may include additional or different features that limit the degree of rotation of the trigger lever 110, or the degree of trigger lever rotation may simply be limited by a portion of the trigger lever 110 itself abutting a portion of the trigger housing 106.

When the trigger lever 110 rotates in the clockwise direction about the trigger-housing shaft 130, the protrusion 144 pushes against the second linkage member 128 until the linkage assembly 125 is forced out of the first position (FIG. 3A; e.g., over-center configuration or centered configuration) and into a collapsed configuration that defines the second position of the linkage assembly 125 (FIG. 3B). In this collapsed configuration, a first line segment drawn between the linkage-housing shaft 132 and the linkage joint 133 and a second line segment drawn between the linkage joint 133 and the sear joint 135 form an angle that is greater than 180°.

More specifically, as the amount of force applied by the protrusion 144 onto the second linkage member 128 increases, the second linkage member 128 and the linkages coupled thereto (e.g., the first linkage member 126) begin to move forward and rotate about the adjacent pivot points (e.g., the linkage joint 133, the sear joint 135, and the linkage-housing joint 131). Moving the linkage assembly 125 out of alignment (i.e., away from the first position) causes a decrease in the countering compressive forces applied by the trigger lever 110 and the first linkage member 126 that locked the sear 124 into the extended position. Eventually, the force applied by the striking assembly 102 on the sear 124 overcomes the decreasing countering compressive forces (e.g., when the linkage assembly 125 is beyond top dead center) such that the linkage assembly 125 moves into the second, collapsed position and the sear 124 rotates in a clockwise direction about the sear-housing shaft 136 into the retracted position. During this actuation, the second linkage member 128 rotates in a counterclockwise direction about the linkage shaft 118, and the linkage joint 133 moves forward (e.g., across a longitudinal axis of the firearm 100 away from the user) within a cavity 107 of the trigger housing 106. This causes the first linkage member 126 to rotate in a clockwise direction about the linkage-housing shaft 132 and the linkage shaft 118 such that the first and second linkage members 126 and 128 move toward each other. The movement of the linkage assembly 125 causes the sear 124 to move to the second, retracted position in which the sear 124 retracts partially or completely into the cavity 107 of the trigger housing 106 until the sear 124 rotates out of the path of the striking feature 150. Once the sear 124 is retracted, the striking feature 150 can pass over the retracted sear 124 to initiate firing of the firearm 100.

In some embodiments, the trigger assembly 104 may further include a reset member 146, such as a spring, attached to the trigger housing 106 and a portion of the linkage assembly 125, such as the first linkage member 126. When the trigger assembly 104 is in the first state (FIG. 3A), the reset member 146 may be in an expanded first or neutral state such that the reset member 146 applies at most a negligible force on the linkage assembly 125. When the trigger assembly 104 is in the second state (FIG. 3B), the reset member 146 assumes a compressed state in which the reset member 146 exerts a force on the first linkage member 126 to push the first linkage member 126 in a counterclockwise direction about the linkage-housing shaft 132 and force the linkage assembly 125 back into the first position (FIG. 3A; i.e., the primed, ready-to-fire configuration).

After the firearm 100 has been fired, the striking assembly 102 and the trigger assembly 104 may remain in the second state (FIG. 3B) until the firearm 100 is either manually or automatically reset. In some embodiments, for example, the striking assembly 102 includes a grasping means, such as a lever, a handle, and/or other manually manipulatable member, that is operably coupled to the striking feature 150.

When the firearm 100 is in the second state, a user may manipulate the grasping means to pull the striking assembly 102 rearward and compress the main spring 154 until the striking feature 150 is positioned rearward of the engagement surface 148 of the sear 124. At this point, the force applied by the reset member 146 pushes the first linkage member 126 in a counterclockwise direction about the linkage-housing shaft 132, which causes the second linkage member 128 to rotate in the clockwise direction about the linkage shaft 118 and the linkage-sear shaft 134. This movement causes the sear 124 to rotate in a counterclockwise direction about the sear-housing shaft 136 until the sear 124 returns to the upright and extended position in which the striking feature 150 once again engages with the engagement surface 148 of the sear 124 (FIG. 3A). The resetting motion of the linkage assembly 125 may also cause the linkage assembly 125 to apply rearward pressure on a portion of the trigger lever 110 (e.g., the protrusion 144) that rotates the trigger lever 110 in a counterclockwise direction about the trigger-housing shaft 130 until the trigger lever 110 contacts the engagement member 140. In other embodiments, the trigger assembly 104 and the linkage assembly 125 can be reset to the first state using other suitable reset means.

As discussed above, the interlock blade 112 can be operably coupled to the linkage assembly 125 to serve as an additional safety mechanism for the firearm 100. For example, when the trigger assembly 104 is in the first state (FIG. 3A), a portion of the interlock blade 112 (e.g., a protrusion, an interface surface, a recess, etc.) engages with a notch 117 of the first linkage member 126. When the notch 117 is engaged with the interlock blade 112, the interlock blade 112 prevents the first linkage member 126 from rotating about the linkage-housing shaft 132 in a clockwise direction, effectively locking the first linkage member 126 in the first state. To fire the firearm 100, a user of the firearm 100 may disengage the interlock blade 112 by pulling the interlock blade 112 towards the trigger lever 110 at least partially into or through the slot 113, which causes the interlock blade 112 to rotate in the clockwise direction about the trigger-housing shaft 130. As the interlock blade 112 rotates, the portion of the interlock blade 112 engaged with the notch 117 of the first linkage member 126 may disengage from the notch 117. The user may continue to pull the interlock blade 112 until a forward-facing edge or surface 119 of the interlock blade 112 is aligned with a forward-facing edge or surface 119 of the trigger lever 110. At this point, the interlock blade 112 is completely disengaged from the first linkage member 126, and the user may fire the firearm 100 by pulling both the trigger lever 110 and the interlock blade 112 together in a rearward direction (e.g., as shown in FIG. 3B) to fire the firearm 100. This arrangement of the trigger lever 110 and interlock blade 112 allows the user to fire the firearm 100 with a single pulling motion, while still providing an additional safety mechanism to limit the likelihood of an accidental firing of the firearm 100. In other embodiments, the interlock blade 112 may engage with other portions of the linkage assembly 125 and/or intermediate components to prevent the linkage assembly 125 and other components operably coupled thereto (e.g., the sear 124) from moving until the interlock blade 112 is disengaged by the user.

As previously mentioned, in embodiments of the firearm 100 that include the interlock blade 112, the firearm 100 may also include an interlock spring 142 attached to the interlock blade 112 and the trigger housing 106. After the interlock blade 112 has been pulled and has disengaged with the notch in the first linkage member 126, the interlock spring 142 may be in a stretched arrangement. When the pulled interlock blade 112 is released, the stretched interlock spring 142 may apply a force on the interlock blade 112 to rotate the interlock blade 112 in a counterclockwise direction about the trigger-housing shaft 130 until the interlock blade 112 returns to its primed, ready-to-fire position and reengages with the notch in the first linkage member 126.

The arrangement of the trigger assembly 104 described with respect to FIGS. 1-3B provides a crisp release and a predictable experience for a user of the firearm, without relying on complex material processing to ensure reliable function of the trigger assembly. During the trigger pulling process, the sear 124 stays in the upright and extended position (FIG. 3A) until the trigger lever 110 has been pulled to a critical actuation point. Before the trigger lever 110 reaches the critical point, the position of the sear 124 remains relatively unchanged, meaning that the pressure applied by the striking feature 150 on the engagement surface 148 of the sear 124 remains constant throughout the trigger pulling process. However, as soon as the trigger lever 110 reaches the critical point, the force from the main spring 154 overpowers the countering compressive forces provided by the trigger assembly 104 and immediately transitions the linkage assembly 125 into the collapsed, second state (FIG. 3B). This instantaneous transition provides little, if any, resistance to the striking feature 150 as it moves towards the cartridge to fire the firearm 100. Because the pressure applied by the striking feature 150 on the engagement surface 148 of the sear 124 remains relatively constant, the sear 124 does not require the typical complex and expensive material processing to increase its strength. Furthermore, the immediate transition of the components of the trigger assembly 104 from the first state to the second state provides a crisp release of the striking assembly 102, resulting in a predictable and enjoyable experience for a user of the firearm 100.

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. In some cases, well-known structures and functions have not been shown and/or described in detail to avoid unnecessarily obscuring the description of the embodiments of the present technology. Although steps of methods may be presented herein in a particular order, in alternative embodiments the steps may have another suitable order. Similarly, certain aspects of the present technology disclosed in the context of particular embodiments can be combined or eliminated in other embodiments. Furthermore, while advantages associated with certain embodiments may have been disclosed in the context of those embodiments, other embodiments can also exhibit such advantages, and not all embodiments need necessarily exhibit such advantages or other advantages disclosed herein to fall within the scope of the present technology. Accordingly, this disclosure and associated technology can encompass other embodiments not expressly shown and/or described herein.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like are used throughout this disclosure to mean including at least the recited feature(s) such that any greater number of the same feature(s) and/or one or more additional types of features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments.

I claim:

1. A trigger assembly for a firearm, comprising:

a trigger lever rotatable about a first fixed pivot point between a first trigger position and a second trigger position, wherein the trigger assembly is in a primed state when the trigger lever is in the first trigger position and is in an unprimed state when the trigger lever is in the second trigger position;

a sear rotatable about a second fixed pivot point between a first sear position and a second sear position, wherein the sear is configured to release a striking element when in the second sear position;

a first linkage member that is rotatable about a third fixed pivot point between a first linkage position and a second linkage position; and a second linkage member between the first linkage member and the sear, the second linkage member being rotatably coupled to the first linkage member at a first joint, rotatably coupled to the sear at a second joint, and operably coupled to the trigger lever, whereinthe third fixed pivot point defines a central axis extending through the second joint, when the first linkage member is in the first linkage position, the first joint is positioned on the central axis or at a first side of the central axis, rotation of the trigger lever to the second trigger position contacts the second linkage member and thereby applies a force on the second linkage member to move the first joint to a second side of the central axis causing the first and second linkage members to rotate relative to each other about the first joint and to rotate the first linkage member about the third fixed pivot point to the second linkage position, and rotation of the first linkage member to the second linkage position causes the sear to rotate about the second fixed pivot point to the second sear position to allow for the release of the striking element.

2. The trigger assembly of claim 1, whereinthe first joint is a first movable pivot point, and the second joint is a second movable pivot point.

3. The trigger assembly of claim 2, wherein:

a first line segment extends from the third fixed pivot point to the first movable pivot point;

a second line segment extends from the first movable pivot point to the second movable pivot point;

the first and second line segments form a first angle when the first linkage member is in the first linkage position and the sear is in the first sear position; and the first line segment and the second line segment form a second angle different from the first angle when the first linkage member is in the second linkage position and the sear is in the second sear position.

4. The trigger assembly of claim 3 wherein the first angle is at most 180° and the second angle is greater than 180°.

5. The trigger assembly of claim 1, further comprising a reset spring coupled to the first linkage member, wherein the reset spring is in a compressed state when the first linkage member is in the second linkage position such that the reset spring exerts a force against the first linkage member to move the first linkage member to the first linkage position when the trigger lever is released from the second trigger position.

6. The trigger assembly of claim 5, wherein the first linkage member is configured to push the trigger lever to the first trigger position from the second trigger position as the first linkage member is pushed from the second linkage position to the first linkage position by the reset spring expanding from the compressed state.

7. A trigger assembly for a firearm, comprising:

a trigger lever rotatable about a first fixed pivot point between a first trigger position and a second trigger position, wherein the trigger assembly is in a primed state when the trigger lever is in the first trigger position and is in an unprimed state when the trigger lever is in the second trigger position;

a sear rotatable about a second fixed pivot point between a first sear position and a second sear position, wherein the sear is configured to release a striking element when in the second sear position;

a first linkage member that is rotatable about a third fixed pivot point between a first linkage position and a second linkage position;

a second linkage member between the first linkage member and the sear, the second linkage member being rotatably coupled to the first linkage member at a first joint, rotatably coupled to the sear at a second joint, and operably coupled to the trigger lever, whereinthe third fixed pivot point defines a central axis extending through the second joint, when the first linkage member is in the first linkage position, the first joint is positioned n the central axis or at a first side of the central axis, rotation of the trigger lever to the second trigger position applies a force on the second linkage member to move the first joint to a second side of the central axis causing the first and second linkage members to rotate relative to each other about the first joint and to route the first linkage member about the third fixed pivot point to the second linkage position, and rotation of the first linkage member to the second linkage position causes the sear to rotate about the second fixed pivot point to the second sear position to allow for the release of the striking element; and an interlock blade adjacent to the trigger lever and rotatable about the first fixed pivot point between a first interlock position and a second interlock position, whereinthe first linkage member has a notch that engages with a surface of the interlock blade when the first linkage member is in the first linkage position and the interlock blade is in the first interlock position, wherein the interlock blade is configured to prevent the first linkage member from rotating from the first linkage position to the second linkage position when the interlock blade is engaged with the first linkage member, and the interlock blade is configured to disengage from the notch when the interlock blade rotates from the first interlock position to the second interlock position.

8. The trigger assembly of claim 7, further comprising:

an interlock spring, wherein the interlock spring is configured to pull the interlock blade from the second interlock position to the first interlock position.

9. The trigger assembly of claim 1, further comprising:

an adjustment member configured to change a location of the first trigger position, wherein the position of the first joint when the first linkage member is in the first linkage position is dependent on the location of the first trigger position.

* * * * *